US005963170A

United States Patent [19]

Garner et al.

[11] Patent Number: 5,963,170

[45] **Date of Patent: *Oct. 5, 1999**

[54] FIXED DUAL FREQUENCY BAND ANTENNA

[75] Inventors: William J. Garner, Yardley, Pa.; Ilya A. Korisch, Eatontown, N.J.

[73] Assignee: Lucent Technologies Inc., Murray Hill, N.J.

[ * ] Notice: This patent is subject to a terminal disclaimer.

[21] Appl. No.: 08/861,588

[22] Filed: May 22, 1997

[51] Int. Cl.[6] ..... H01Q 1/24; H01Q 1/36

[52] U.S. Cl. ..... 343/702; 343/715; 343/725; 343/729; 343/895; 343/900

[58] Field of Search ..... 343/702, 895, 343/752, 703, 749, 715, 725, 729, 900

[56] References Cited

U.S. PATENT DOCUMENTS

| | | | |
|---|---|---|---|
| 4,229,743 | 10/1980 | Vo et al. | 343/895 |
| 4,725,395 | 2/1988 | Gasparaitis et al. | 343/895 |
| 5,329,287 | 7/1994 | Strickland | 343/752 |
| 5,426,440 | 6/1995 | Shimada et al. | 343/702 |
| 5,606,327 | 2/1997 | Elliott et al. | 343/702 |
| 5,717,409 | 2/1998 | Garner et al. | 343/702 |
| 5,739,792 | 4/1998 | Hassemer et al. | 343/702 |
| 5,801,662 | 9/1998 | Itoh | 343/702 |

*Primary Examiner*—Don Wong
*Assistant Examiner*—Hoang Nguyen

[57] ABSTRACT

A fixed dual frequency band antenna for a dual frequency band radio transceiver where the two frequency bands are not harmonically related. The antenna includes a straight radiating antenna portion terminated by a helical wire radiating antenna portion, with the total electrical length of the antenna being approximately three quarters of the wavelength at the center frequency of the higher of the two frequency bands. A conductive radiating cap terminates the helical portion and a conductive antenna base is connected to the straight portion at the end opposite the helical portion. A matching circuit coupled between the base and the transceiver circuitry is arranged to substantially cancel the reactive portion of the impedance of the antenna for both frequency bands and to substantially equalize the resistive portion of the impedance of the antenna to the resistive portion of the output impedance of the radio transceiver. The length of the antenna is such that, together with the matching circuit, the resistive portion of the impedance of the antenna is substantially the same for both frequency bands.

8 Claims, 3 Drawing Sheets

FIXED DUAL FREQUENCY BAND ANTENNA

BACKGROUND OF THE INVENTION

This invention relates to a fixed antenna operable in two frequency bands and, more particularly, to such an antenna for use in a handheld communications device.

In recent years, portable handheld wireless communications devices have become increasingly popular. At the present time, cellular telephones operating in the frequency band of 824 MHz through 896 MHz are the most widespread type of such devices. However, the personal communications system (PCS) operating in the frequency band of 1850 MHz through 1990 MHz is gaining in popularity. Accordingly, equipment suppliers are developing portable handheld radio transceivers which operate in both these frequency bands. Thus, there exists a need for an antenna capable of operating in both of the described frequency bands.

If the center frequencies of the two frequency bands were harmonically related, it would be a relatively simple matter to design an antenna operable for both of the bands. However, for the frequency bands discussed above, where the ratio between the center frequencies of the two bands is in the range between two and three, such a harmonic relationship does not exist. Accordingly, there also exists a need for an antenna operable for two frequency bands which are not harmonically related.

Handheld portable radio transceivers must be designed in accordance with certain human factors considerations. Thus, such a device should be compact and lightweight. It is known to design such a device with a rod (or whip) antenna which is selectively retractable into, or extendable out of, the device case. Frequently, the user wishes to place the transceiver in a pocket or purse, but at the same time keep the transceiver turned on so that a call can be received and the user notified of such receipt. This requires a short antenna. However, a retractable antenna with moving parts increases the cost of the transceiver. Thus, there exists a further need for a short fixed antenna which is operable in two frequency bands which are not harmonically related and which provides performance similar to that of an extendable antenna.

SUMMARY OF THE INVENTION

In accordance with the principles of this invention, there is provided a fixed dual frequency band antenna for use in a radio transceiver device wherein the two frequency bands are not harmonically related and the ratio between center frequencies of the two frequency bands is in the range from about two to about three. The inventive antenna comprises a straight radiating antenna portion terminated by a helical wire radiating antenna portion. The total electrical length of the antenna is approximately three quarters of the wavelength at the center frequency of the higher of the two frequency bands. The helical portion is terminated by a conductive radiating cap. A conductive antenna base is connected to the straight portion at the end opposite the helical portion. A matching circuit is coupled between the radio transceiver device and the antenna base. The matching circuit is arranged to substantially cancel the reactive portion of the impedance of the antenna for both frequency bands and to substantially equalize the resistive portion of the impedance of the antenna to the resistive portion of the output impedance of the radio transceiver device. The length of the antenna is such that together with the matching circuit the resistive portion of the impedance of the antenna is substantially the same for both frequency bands.

DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
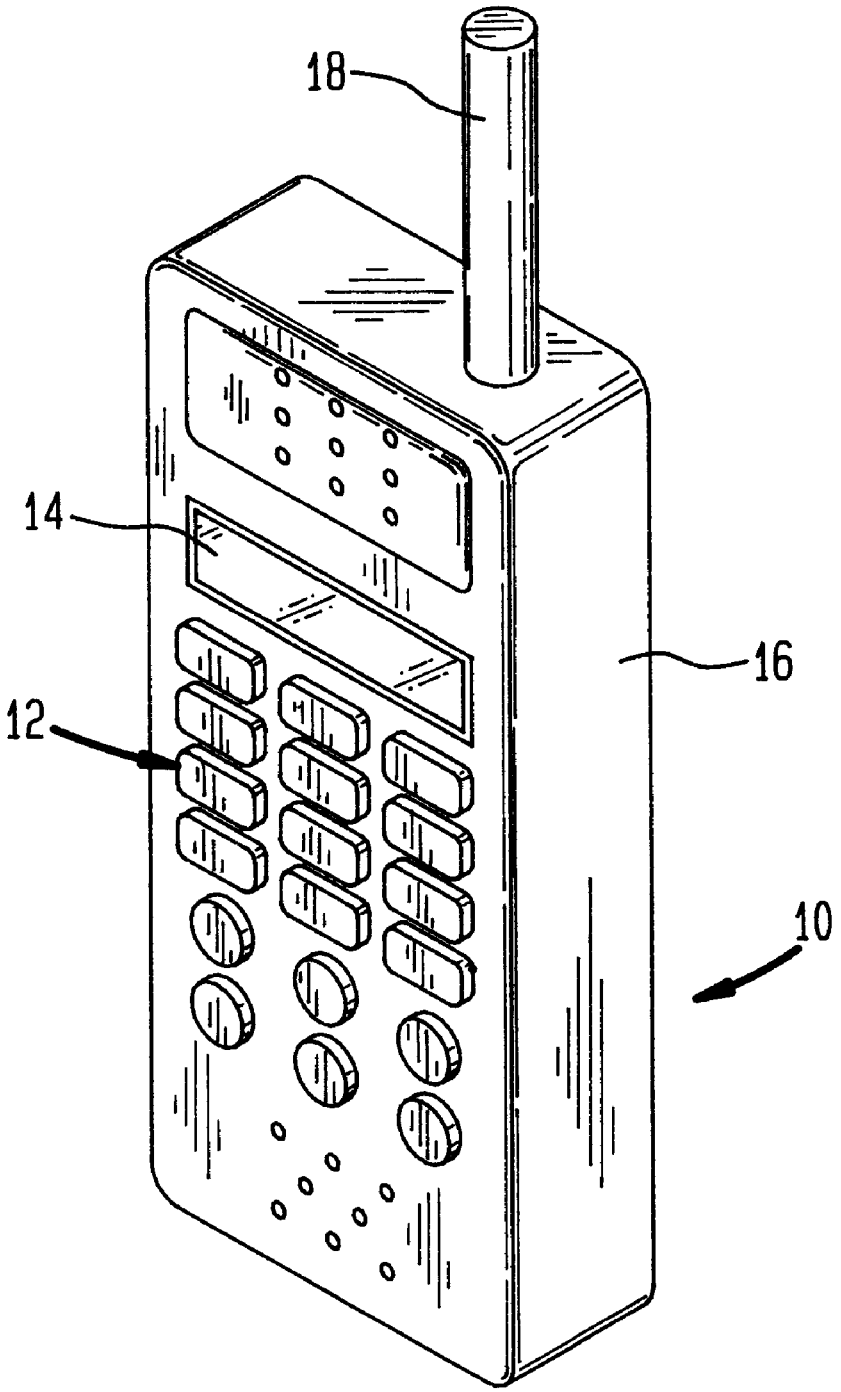
FIG. 1 is a perspective view of a handheld communications device in which an antenna constructed in accordance with the principles of this invention is incorporated.

Referring now to the drawings, FIG. 1 shows a handheld portable communications device, designated generally by the reference numeral 10, having a data entry keypad 12 and a display 14 disposed on one surface of the insulative case 16. An insulative antenna protective cover 18 is mounted to the upper surface of the case 16. As will be described in full detail hereinafter, the cover 18 contains a short fixed antenna constructed according to this invention.

Figure 2:
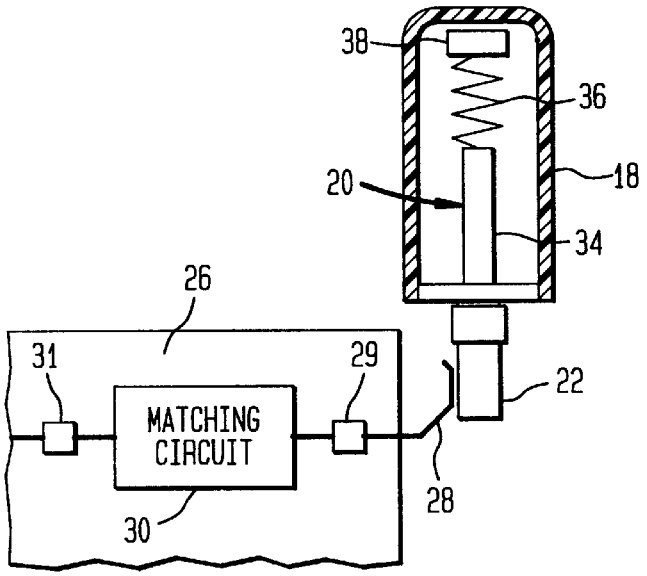
FIG. 2 is a schematic cross sectional view of an illustrative antenna according to this invention and also shows an arrangement for coupling the antenna to a printed circuit board within the handheld communications device.

As shown schematically in FIG. 2, the antenna 20 is contained within the cover 18. The antenna 20 includes a conductive antenna base 22 which is coupled to circuitry on the printed circuit board 26, which is within the case 16 and supports transceiver circuitry (not shown) thereon. Such coupling illustratively is via the spring clip 28 and through the terminal 29 and the matching circuit 30, which is connected to the antenna feed terminal 31 of the transceiver circuitry. The antenna 20 includes a straight radiating portion 34 with one end connected to the conductive base 22 and the other end terminated by a helical wire radiating portion 36. A conductive radiating cap 38 terminates the helical portion 36. The straight portion 34 can be a continuation of the wire forming the helical portion 36 or, alternatively, can be a hollow conductive sleeve or a hollow cylindrical arc segment coaxial with the axis of the helical portion 36. The cap 38 may be formed by a plurality of turns of the helical portion 36 (preferably at least three) which are tightly wound so as to abut each other and which then may be soldered or welded together, if so desired. The length of the cap 38 along the axis of the helical portion 36 should be at least one half the diameter of the helical portion 36. The function of the cap 38 is to expand the bandwidth at the higher frequency band.

The total length of the antenna 20 is selected to be about three quarters of the wavelength of the center frequency of the higher of the two frequency bands and about one quarter of the wavelength of the center frequency of the lower of the two frequency bands. In particular, the length of the antenna 20 is in the range from about 0.62 through about 0.80 of the wavelength of the center frequency of the higher frequency band and in the range from about 0.25 through about 0.35 of the wavelength of the center frequency of the lower frequency band.

Figure 3:
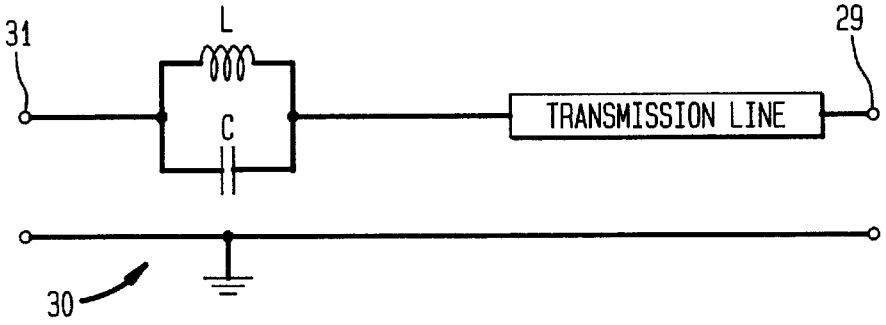
FIG. 3 is a schematic electrical circuit diagram showing a first embodiment of a matching circuit for use with the antenna according to this invention.
Figure 4:
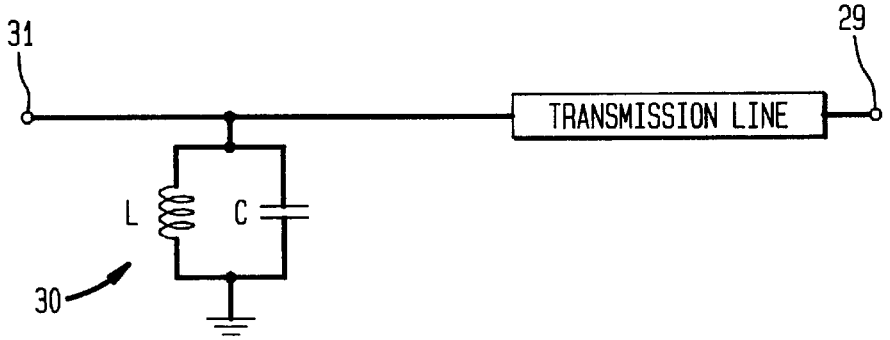
FIG. 4 is a schematic electrical circuit diagram showing a second embodiment of a matching circuit for use with the antenna according to this invention.

As previously discussed, there is a matching circuit 30 on the printed circuit board 26 coupled between the antenna and the transceiver circuitry. Viewed from the terminal 29 connected to the base 24, at the lower center frequency $f_1$ the impedance of the antenna is $R_1+jX_1$, and at the higher center frequency $f_2$ the impedance of the antenna is $R_2+jX_2$. The antenna components and the matching circuit 30 are selected so that $R_1$ and $R_2$ are transformed to become substantially equal to $R_0$ at the terminal 31, where $R_0$ is the resistive portion of the output impedance of the transceiver circuitry at the antenna feed terminal 31. The matching circuit 30 is further designed so that at the frequency $f_1$, the matching circuit 30 cancels the reactive component $jX_1$ and at the frequency $f_2$ the matching circuit 30 cancels the reactive component $jX_2$. Thus, a single matching circuit is operative in both of the frequency bands. FIGS. 3 and 4 illustrate two possible configurations for the matching circuit 30, both of which include a tank circuit and a section of transmission line. The characteristic impedance and length of the section of transmission line are chosen to equalize the resistive portion of the antenna impedance at the center frequencies of the two frequency bands. The tank circuit compensates for the remaining reactance.

Figure 5:
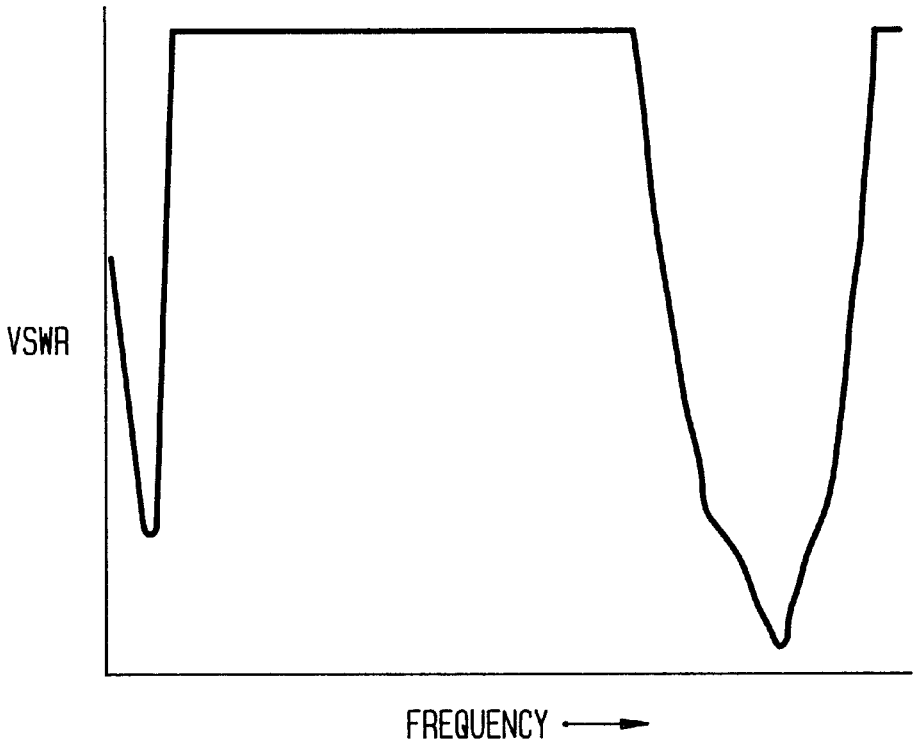
FIG. 5 is a waveform showing the voltage standing wave ratio (VSWR) versus frequency for the antenna of this invention.

FIG. 5 illustrates the resonant behavior (frequency versus voltage standing wave ratio) for the antenna 20 at the two frequency bands. It is noted that satisfactory operation is attained at both frequency bands. It has been found that the dimensions of the antenna 20 can be varied to vary the bandwidths at the two frequency bands of interest. Thus, by controlling the ratio of the lengths of the helical portion and the straight portion of the antenna, the relative bandwidths at the two center frequencies can be controlled. Thus, by increasing the length of the straight portion 34, the bandwidth at the lower frequency band is decreased and the bandwidth at the higher frequency band is increased.

Accordingly, there has been disclosed an improved fixed dual frequency band antenna for a radio transceiver. The disclosed antenna is less expensive than an extendable/retractable antenna and has been found to offer similar performance. While an illustrative embodiment of the present invention has been disclosed herein, it is understood that various modifications and adaptations to the disclosed embodiment will be apparent to one of ordinary skill in the art and it is intended that this invention be limited only by the scope of the appended claims.

What is claimed is:

1. A fixed dual frequency band antenna for use in a radio transceiver device wherein the two frequency bands are not harmonically related and the ratio between center frequencies of the two frequency bands is in the range from about two to about three, the antenna comprising:

a fixed straight radiating antenna portion terminated by a helical wire radiating antenna portion, the total electrical length of said antenna being approximately three quarters of the wavelength at the center frequency of the higher of the two frequency bands;

a conductive radiating cap terminating said helical wire portion;

a conductive antenna base connected to said fixed straight portion at the end opposite said helical wire portion; and a matching circuit coupled between said radio transceiver device and said base, said matching circuit being arranged to substantially cancel the reactive portion of the impedance of the antenna for both frequency bands and to substantially equalize the resistive portion of the impedance of the antenna to the resistive portion of the output impedance of the radio transceiver device;

wherein the length of said antenna is such that, together with said matching circuit, the resistive portion of the impedance of the antenna is substantially the same for both frequency bands.

2. The antenna according to claim 1 wherein said cap includes a plurality of turns of said helical wire portion which are abutting in the longitudinal direction.

3. The antenna according to claim 2 wherein the length of said cap along the axis of said helical wire portion is at least one-half the diameter of said helical wire portion.

4. The antenna according to claim 1 wherein:

a first of said frequency bands covers the range from about 824 MHz through about 896 MHz;

the second of said frequency bands covers the range from about 1850 MHz through about 1990 MHz; and the length of said antenna is in the range from about 0.25 through about 0.35 of the wavelength at 850 MHz.

5. The antenna according to claim 1 wherein the ratio of the length of the fixed straight antenna portion to the helical wire portion is selected to achieve desired bandwidths in the two frequency bands.

6. The antenna according to claim 1 wherein the fixed straight antenna portion comprises a straight wire.

7. The antenna according to claim 6 wherein the fixed straight antenna portion is formed unitarily with the helical wire portion from a single wire.

8. The antenna according to claim 1 wherein the fixed straight antenna portion comprises a hollow cylindrical arc segment co-axial with the axis of the helical wire portion.

* * * * *